US008434243B2

(12) United States Patent
Kim et al.

(10) Patent No.: US 8,434,243 B2
(45) Date of Patent: May 7, 2013

(54) LAUNDRY DRYER

(75) Inventors: Young Soo Kim, Changwon-si (KR); Soung Bong Choi, Changwon-si (KR); Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 1233 days.

(21) Appl. No.: 11/656,460

(22) Filed: Jan. 23, 2007

(65) Prior Publication Data

US 2007/0180728 A1 Aug. 9, 2007

(30) Foreign Application Priority Data

Jan. 25, 2006 (KR) ..... 10-2006-0007834

(51) Int. Cl.
*F26B 11/00* (2006.01)

(52) U.S. Cl.
USPC ..... 34/606

(58) Field of Classification Search ..... 34/601, 34/606, 610
See application file for complete search history.

(56) References Cited

U.S. PATENT DOCUMENTS

| | | | | | |
|---|---|---|---|---|---|
| 2,547,238 | A | * | 4/1951 | Tremblay | 34/603 |
| 2,737,729 | A | * | 3/1956 | Engel | 34/602 |
| 2,798,304 | A | * | 7/1957 | Reiter | 34/91 |
| 2,798,306 | A | * | 7/1957 | Reiter | 34/609 |
| 2,798,307 | A | * | 7/1957 | Reiter | 34/610 |
| 2,827,783 | A | * | 3/1958 | Handley | 68/12.15 |
| 2,961,776 | A | * | 11/1960 | Hughes | 34/607 |
| 2,983,050 | A | * | 5/1961 | Alaback | 34/90 |
| 3,180,037 | A | * | 4/1965 | Kenreich et al. | 34/597 |
| 3,197,886 | A | * | 8/1965 | Brame et al. | 34/90 |
| 3,218,732 | A | * | 11/1965 | Alaback | 34/603 |
| 3,239,947 | A | * | 3/1966 | Kenreich et al. | 34/597 |
| 3,277,584 | A | * | 10/1966 | Krolzick | 34/601 |
| 3,333,346 | A | * | 8/1967 | Brucken | 34/131 |
| 3,364,592 | A | * | 1/1968 | Nighswander et al. | 34/601 |
| 3,399,464 | A | * | 9/1968 | Erickson et al. | 34/605 |
| 3,429,056 | A | * | 2/1969 | Metzger | 34/601 |
| 3,634,947 | A | * | 1/1972 | Furgal | 34/60 |
| 3,805,404 | A | * | 4/1974 | Gould | 34/75 |
| 3,831,063 | A | * | 8/1974 | Keough | 361/679.08 |
| 3,872,604 | A | * | 3/1975 | Keller | 34/342 |
| 3,945,936 | A | * | 3/1976 | Lucas et al. | 252/186.2 |
| 3,959,891 | A | * | 6/1976 | Burkall | 34/82 |

(Continued)

FOREIGN PATENT DOCUMENTS

| | | |
|---|---|---|
| DE | 43 27 916 | 2/1994 |
| KR | 10-2005-0049245 | 5/2005 |
| WO | WO 02/090640 | 11/2002 |

OTHER PUBLICATIONS

German Office Action dated Apr. 16, 2009.

*Primary Examiner* — Stephen Gravini
(74) *Attorney, Agent, or Firm* — KED & Associates LLP

(57) ABSTRACT

Laundry dryer including a body case forming an exterior of the laundry dryer, a drum in the body case for holding a drying object, a heater assembly in the body case for heating air to supply hot air to the drum, a panel frame on a front of the body case, having an opening in communication with a space having the heater assembly mounted therein, and a control panel mounted to the panel frame selectively, having buttons for making various operation, thereby permitting easy handling of the operation buttons on the control panel even if two or more than two dryers are arranged in any type, and improving workability of replacement or repair of the heater assembly.

12 Claims, 5 Drawing Sheets

U.S. PATENT DOCUMENTS

| | | | | | |
|---|---|---|---|---|---|
| 4,007,546 | A * | 2/1977 | Sauer | 34/602 |
| 4,069,596 | A * | 1/1978 | Sisler | 34/242 |
| 4,086,053 | A * | 4/1978 | Sommer, Jr. | 432/222 |
| 4,130,392 | A * | 12/1978 | Diehl et al. | 8/101 |
| 4,207,683 | A * | 6/1980 | Horton | 34/60 |
| 4,236,320 | A * | 12/1980 | Schwadike et al. | 34/428 |
| 4,360,977 | A * | 11/1982 | Frohbieter | 34/86 |
| 4,395,261 | A * | 7/1983 | Lutz | 8/111 |
| 4,489,455 | A * | 12/1984 | Spendel | 8/158 |
| 4,489,574 | A * | 12/1984 | Spendel | 68/16 |
| 4,555,019 | A * | 11/1985 | Spendel | 206/223 |
| 4,621,438 | A * | 11/1986 | Lanciaux | 34/77 |
| 4,669,199 | A * | 6/1987 | Clawson et al. | 34/82 |
| 4,689,896 | A * | 9/1987 | Narang | 34/82 |
| 4,702,018 | A * | 10/1987 | Hastings | 34/130 |
| 4,811,495 | A * | 3/1989 | Huang et al. | 34/131 |
| 4,891,892 | A * | 1/1990 | Narang | 34/86 |
| 4,972,605 | A * | 11/1990 | Montalvo | 34/513 |
| 5,127,169 | A * | 7/1992 | Ellingson | 34/601 |
| 5,257,468 | A * | 11/1993 | Lebrun | 34/235 |
| 5,371,956 | A * | 12/1994 | St. Louis | 34/599 |
| 5,463,821 | A * | 11/1995 | Gauer | 34/261 |
| 5,651,188 | A * | 7/1997 | Swanson et al. | 34/82 |
| 5,661,914 | A * | 9/1997 | Millet | 34/601 |
| 5,664,339 | A * | 9/1997 | Swanson et al. | 34/82 |
| 5,749,163 | A * | 5/1998 | Staub et al. | 34/597 |
| 5,806,204 | A * | 9/1998 | Hoffman et al. | 34/92 |
| 5,887,456 | A * | 3/1999 | Tanigawa et al. | 68/20 |
| 5,901,465 | A * | 5/1999 | Boussetta et al. | 34/602 |
| 5,940,988 | A * | 8/1999 | Eisen | 34/596 |
| 5,980,583 | A * | 11/1999 | Staub et al. | 8/149.2 |
| 6,067,723 | A * | 5/2000 | Lafrenz | 34/61 |
| 6,088,932 | A * | 7/2000 | Adamski et al. | 34/274 |
| 6,098,312 | A * | 8/2000 | Tuggle | 34/607 |
| 6,151,795 | A * | 11/2000 | Hoffman et al. | 34/92 |
| 6,195,910 | B1 * | 3/2001 | Robineau | 34/417 |
| 6,385,862 | B1 * | 5/2002 | Vande Haar | 34/441 |
| 6,493,963 | B1 * | 12/2002 | England | 34/491 |
| 6,519,871 | B2 * | 2/2003 | Gardner et al. | 34/497 |
| 6,604,298 | B2 * | 8/2003 | Tomasi et al. | 34/600 |
| 6,637,127 | B2 * | 10/2003 | Reede et al. | 34/527 |
| 6,732,447 | B2 * | 5/2004 | Tomasi et al. | 34/90 |
| 6,766,596 | B1 * | 7/2004 | Bienick et al. | 34/601 |
| 6,829,845 | B2 * | 12/2004 | Han et al. | 34/603 |
| 6,874,248 | B2 * | 4/2005 | Hong et al. | 34/239 |
| 6,889,399 | B2 * | 5/2005 | Steiner et al. | 8/159 |
| 6,922,913 | B2 * | 8/2005 | Hood et al. | 34/595 |
| 6,941,680 | B1 * | 9/2005 | Zielewicz et al. | 34/607 |
| 6,954,992 | B2 * | 10/2005 | Hwang | 34/108 |
| 7,024,801 | B2 * | 4/2006 | Hwang | 34/603 |
| 7,043,855 | B2 * | 5/2006 | Heilman et al. | 34/389 |
| 7,047,663 | B2 * | 5/2006 | Zhang et al. | 34/348 |
| 7,059,065 | B2 * | 6/2006 | Gerlach et al. | 34/381 |
| 7,066,412 | B2 * | 6/2006 | Conley et al. | 239/690 |
| 7,140,123 | B2 * | 11/2006 | Lee | 34/601 |
| 7,146,749 | B2 * | 12/2006 | Barron et al. | 34/596 |
| 7,162,812 | B2 * | 1/2007 | Cimetta et al. | 34/469 |
| 7,228,647 | B2 * | 6/2007 | Hong | 34/596 |
| 7,320,184 | B2 * | 1/2008 | Zhang et al. | 34/597 |
| 7,322,127 | B2 * | 1/2008 | Hwang | 34/603 |
| 7,325,332 | B2 * | 2/2008 | Chung et al. | 34/602 |
| 7,360,323 | B2 * | 4/2008 | Lee et al. | 34/601 |
| 7,392,600 | B2 * | 7/2008 | Gerlach et al. | 34/381 |
| 7,415,781 | B2 * | 8/2008 | Barron et al. | 34/595 |
| 7,434,334 | B2 * | 10/2008 | Hwang et al. | 34/606 |
| 7,503,127 | B2 * | 3/2009 | DuVal et al. | 34/381 |
| 2002/0174564 | A1 * | 11/2002 | England | 34/606 |
| 2003/0084590 | A1 * | 5/2003 | Tomasi et al. | 34/595 |
| 2003/0101617 | A1 * | 6/2003 | Prajescu et al. | 34/527 |
| 2004/0020073 | A1 * | 2/2004 | Lee et al. | 34/602 |
| 2004/0103556 | A1 * | 6/2004 | Bang | 34/595 |
| 2004/0107598 | A1 * | 6/2004 | Hwang | 34/601 |
| 2004/0111916 | A1 * | 6/2004 | Hwang | 34/601 |
| 2004/0123488 | A1 * | 7/2004 | Han | 34/595 |
| 2004/0123489 | A1 * | 7/2004 | Pancheri et al. | 34/597 |
| 2004/0134092 | A1 * | 7/2004 | Hong et al. | 34/595 |
| 2004/0163276 | A1 * | 8/2004 | Han et al. | 34/603 |
| 2004/0221478 | A1 * | 11/2004 | Lee et al. | 34/603 |
| 2004/0221479 | A1 * | 11/2004 | Lee et al. | 34/603 |
| 2005/0050762 | A1 * | 3/2005 | Hood et al. | 34/595 |
| 2005/0086831 | A1 * | 4/2005 | Ryu | 34/603 |
| 2005/0097772 | A1 * | 5/2005 | Lee | 34/601 |
| 2005/0097773 | A1 * | 5/2005 | Gardner | 34/606 |
| 2005/0108893 | A1 * | 5/2005 | Hwang et al. | 34/603 |
| 2005/0120586 | A1 * | 6/2005 | Hwang et al. | 34/603 |
| 2005/0138836 | A1 * | 6/2005 | Hwang et al. | 34/603 |
| 2005/0155251 | A1 * | 7/2005 | Lee | 34/604 |
| 2005/0183284 | A1 * | 8/2005 | Hwang et al. | 34/603 |
| 2005/0235519 | A1 * | 10/2005 | Chung | 34/607 |
| 2005/0268483 | A1 * | 12/2005 | Park et al. | 34/603 |
| 2006/0085996 | A1 * | 4/2006 | Hwang | 34/82 |
| 2006/0086001 | A1 * | 4/2006 | Jeong et al. | 34/606 |
| 2006/0096114 | A1 * | 5/2006 | Hong | 34/77 |
| 2006/0123652 | A1 * | 6/2006 | Chung et al. | 34/92 |
| 2006/0150439 | A1 * | 7/2006 | Latack et al. | 34/601 |
| 2006/0218817 | A1 * | 10/2006 | Lee | 34/604 |
| 2006/0265899 | A1 * | 11/2006 | Renzo | 34/603 |
| 2006/0288608 | A1 * | 12/2006 | Carow et al. | 34/604 |
| 2007/0006485 | A1 * | 1/2007 | Kim | 34/603 |
| 2007/0180728 | A1 * | 8/2007 | Kim et al. | 34/88 |
| 2007/0227030 | A1 * | 10/2007 | Oh et al. | 34/60 |
| 2007/0227035 | A1 * | 10/2007 | Leroy | 34/602 |
| 2008/0034611 | A1 * | 2/2008 | Carow et al. | 34/565 |
| 2008/0141558 | A1 * | 6/2008 | Bae et al. | 34/595 |
| 2009/0064534 | A1 * | 3/2009 | LeClerc | 34/603 |

* cited by examiner

LAUNDRY DRYER

This application claims the benefit of the Patent Korean Application No. 10-2006-0007834, filed on Jan. 25, 2006, which is hereby incorporated by reference as if fully set forth herein.

BACKGROUND OF THE INVENTION

1. Field of the Invention

The present invention relates to laundry dryers, more particularly, to a laundry dryer which enables selective mounting/dismounting of a control panel on an upper or lower side of a front of the laundry dryer, as well as easy dismounting of a heater assembly out of the laundry dryer.

2. Discussion of the Related Art

In general, laundry finished with washing is moved to and dried at a drying stand, naturally. However, in a case the weather is irregular, or in a rainy season, the natural drying of the laundry is delayed, such that the busy modern people experience much inconvenience.

Consequently, an appliance for drying the laundry regardless of the weather is required, to develop the laundry dryer.

Recently, it is a trend that demands on the laundry increases rapidly for the busy modern people.

The laundry dryer generates hot air with heating means and blows the hot air toward a drum, to vaporize moisture from a drying object.

In the laundry dryer, there are a condensing type laundry dryer, and an exhaust type laundry dryer depending on a system for processing humid air.

A related art exhaust type laundry dryer will be described with reference to FIG. 1 attached hereto.

Referring to FIG. 1, the laundry dryer is provided with a body case 10, a drum 20, a fan 30, and a heater assembly 40.

The body case 10 forms an exterior of the laundry dryer. The body case 10 has a laundry opening 11 in a front for introducing laundry into the drum 20.

Mounted on an upper side of the body case 10, there is a control unit 12 for controlling operation of the laundry dryer, having an inside with a circuit board 12*a* connected to various electric outfits mounted thereon, and an outside mounted with operation buttons 12*b* and a display window (not shown) connected to the circuit board 12*a* mounted thereon.

The drum 20 is mounted in the body case 10, with an opening aligned with the laundry opening 11. There is a door D at one side of the laundry opening 11 for selective opening/closing of the laundry opening 11.

Mounted under the drum 20, there is the heater assembly 40, and there is the fan 30 on a position different from the heater assembly 40 for blowing the hot air to an outside of the laundry dryer through an inside of the drum 20.

However, the related art laundry dryer has the following problems.

First, in a case the circuit board 12*a* that controls the laundry dryer is out of order, or the various operation buttons 12*b* on the control unit 12 are broken, it has been very inconvenient in repairing or replacing the circuit board 12*a* or the operation buttons 12*b*.

That is, since the control unit 12 is fixedly secured to the body case 10, the servicemen experience substantial inconvenience in repairing.

Second, at the time the heater assembly 40 under the drum 20 is out of order, in order to repair or replace the heater assembly 40, there is difficulty of removing various components mounted above the heater assembly 40.

SUMMARY OF THE INVENTION

Accordingly, the present invention is directed to a laundry dryer.

An object of the present invention is to provide a laundry dryer which enables selective mounting/dismounting of a control panel on an upper or lower side of a front of the laundry dryer, as well as easy dismounting of a heater assembly out of the laundry dryer without disassembly of an entire body case.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry dryer includes a body case forming an exterior of the laundry dryer, a drum in the body case for holding a drying object, a heater assembly in the body case for heating air to supply hot air to the drum, a panel frame on a front of the body case, having an opening in communication with a space having the heater assembly mounted therein, and a control panel mounted to the panel frame selectively, having buttons for making various operation.

Preferably, the panel frame includes an upper panel frame on an upper side of the front of the body case, and a lower panel frame on a lower side of the front of the body case.

Preferably, the heater assembly is mounted in the body case at a lower portion thereof.

Preferably, the lower panel frame has an opening.

In this instance, preferably, the opening and the heater assembly are arranged on a straight line.

Preferably, the opening has a size enough to take out the heater assembly.

Preferably, the control panel can be mounted to the upper panel frame or the lower panel frame, selectively.

Preferably, the laundry dryer further includes a cover panel for covering the other panel frame if the control panel is mounted to one of the upper panel frame and the lower panel frame.

Thus, the laundry dryer of the present invention has the following advantages.

As described, since the control panel can be detachable from the body case, replacement or repair of the operation buttons and the display window on the control panel can be very convenient.

Since the control panel can be mounted to the upper side or lower side of the front of the laundry dryer selectively, the user's handling of the operation buttons on the control panel is convenient even if two or more than two laundry dryers are arranged in any type.

The opening in the panel frame permits easy taking out, and repair of the heater assembly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A laundry dryer in accordance with a first preferred embodiment of the present invention will be described with reference to FIGS. 2 and 3.

Figure 1:
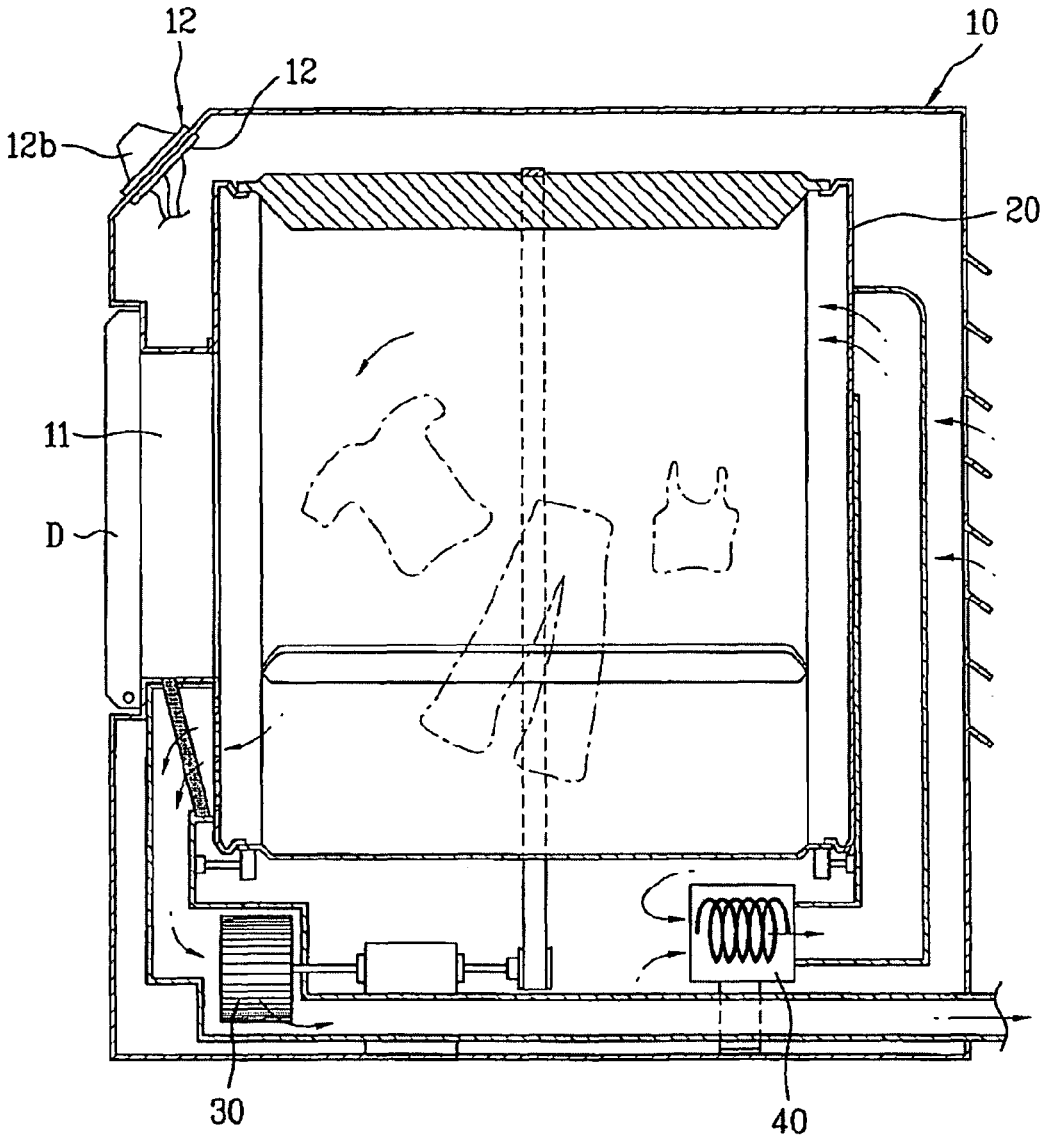
FIG. 1 Prior Art
FIG. 1 is a longitudinal section illustrating a related art laundry dryer.
Figure 2:
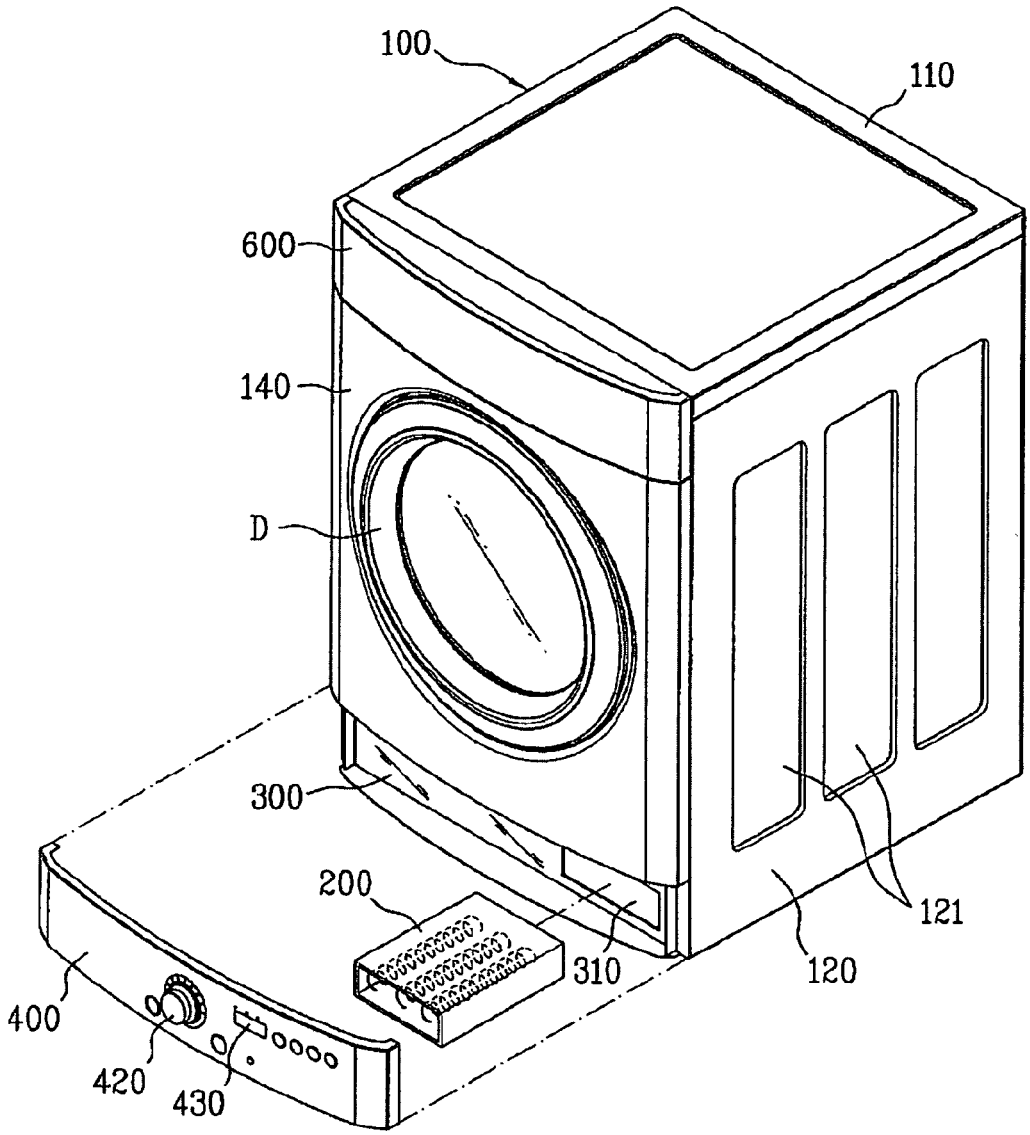
FIG. 2 is an exploded perspective view illustrating a laundry dryer in accordance with a first preferred embodiment of the present invention.

Referring to FIG. 2, the laundry dryer includes a body case 100, a heater assembly 200, a panel frame, and a control panel 400.

The body case 100, an exterior of the laundry dryer, includes a top plate 110 which is a top portion of the laundry dryer, a cabinet 120 which is opposite sides thereof, a back cover 130 which is a rear thereof, and a cover cabinet 140 which forms a portion of a front thereof.

The cover cabinet 140 has a laundry opening 150 for putting in/taking out laundry, and there is a door D at one side of the cover cabinet 140 having the laundry opening 150 formed therein for selective opening/closing of the laundry opening 150.

It is preferable that the back cover 130 has a plurality of air inlets 131 for smooth drawing of external air.

The heater assembly 200 heats the air introduced into the body case 100, and preferably is mounted under the drum Dr.

This is because a lower space of the body case 100 is the most suitable place for mounting the heater assembly 200 therein in view of arrangement of various components in the body case 100.

Figure 3:
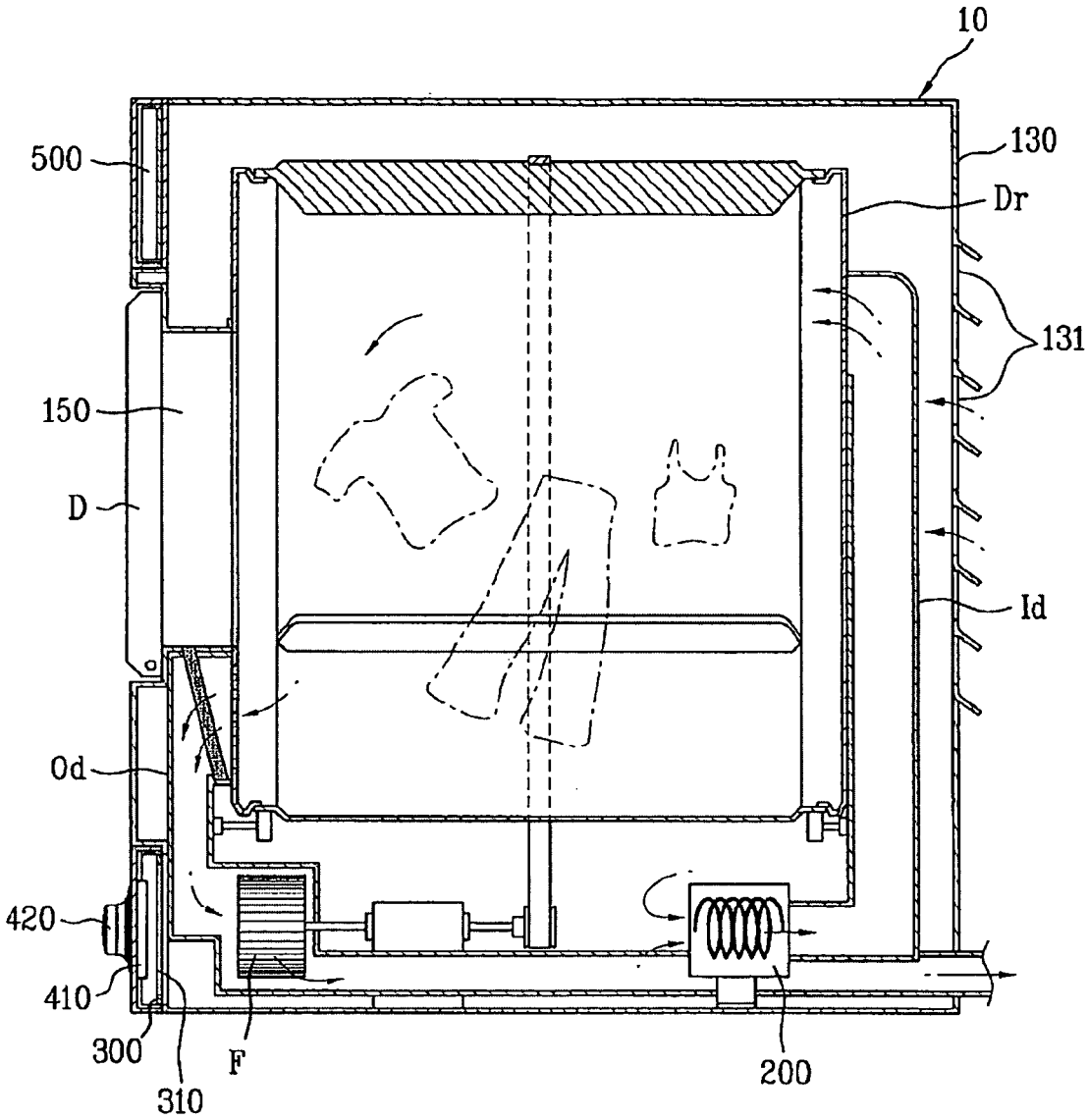
FIG. 3 is a longitudinal section illustrating the laundry dryer in FIG. 2 in an assembled state.

Referring to FIG. 3, the heater assembly 200 and the drum Dr are connected with an inlet duct Id to each other.

The inlet duct Id is a hot air passage from the heater assembly 200 to the drum Dr.

There is an outlet duct Od connected to the other side of the drum Dr. The outlet duct Od is a passage for discharging air and steam that dried the laundry from the drum.

Mounted on an inside of the outlet duct Od, there is the fan F for generating suction force for drawing external air into the drum Dr, and discharging steam from the drum Dr to an outside of the laundry dryer.

The panel frame is mounted to an upper side and a lower side of the cover cabinet 140 for mounting the control panel 400 or the cover panel 600 to be explained later, respectively.

The panel frame includes an upper panel frame 500 mounted to the upper side of the cover cabinet 140, and a lower panel frame 300 mounted to the lower side of the cover cabinet 140.

In the lower panel frame 300, there is an opening 310 for taking the heater assembly 200 out of the body case 100.

The opening 310 is in communication, and arranged on a straight with a space of the body case 100 wherein the heater assembly 200 is mounted.

The opening 310 has a size enough to take out the heater assembly 200.

It is preferable that the opening 310 has a shape similar to an outline of the heater assembly 200 for taking out the heater assembly, easily.

In the meantime, it is preferable that the opening 310 is formed only in the lower panel frame 300 in a case the heater assembly 200 is mounted in a lower portion of the body case 100 like the first embodiment.

The control panel 400 enables the user to control operation of the laundry dryer, and has various operation buttons required for the control mounted thereon.

For this, there is a circuit board 410 on an inside of the control panel 400 having various circuitry components mounted thereon.

The control panel 400 is designed to be mounted on the upper panel frame 500 or the lower panel frame 300, selectively.

Referring to the first embodiment of the present invention, the control panel 400 is mounted on the lower panel frame 300 of the body case 100.

In the meantime, the circuit board 410 has a cable (not shown) exposed to the lower panel frame 300 for transmission of operation of the laundry dryer to the various components.

That is, the cable has one end connected to a connector, and the other end connected to the circuit board 410, electrically.

Mounted on an outside surface of the control panel 400, there are the various operation buttons 420 and the display window 430 connected to the circuit board 410 electrically.

The various operation buttons 420 controls operation of the laundry dryer and the display window 430 displays operation progress of the laundry dryer.

The control panel 400 is designed to be mounted on the lower panel frame 300 of the laundry dryer selectively.

In the meantime, the upper panel frame 500 has the cover panel 600 mounted thereon for covering the upper panel frame 500 from an outside of the laundry dryer.

The cover panel 600 is mounted to the other panel frame if the control panel 400 is mounted to one of the upper panel frame 500 and the lower panel frame 300.

Owing to this, the laundry dryer causes no problem in view of exterior thereof even if the control panel 400 is mounted to either position.

It is preferable that the cover panel 600 has a shape identical to an outer shape of the control panel 400 so that the cover panel 600 can form a portion of a whole exterior of the laundry dryer.

A mounting structure of the cover panel 600 to the panel frame 300 or 500 is identical to a mounting structure of the control panel 400 to the panel frame 300 or 500.

A mounting/dismounting state of the control panel to the lower panel frame of the laundry dryer, and a taking out state of the heater assembly will be described.

The upper panel frame 500 and the lower panel frame 300 are mounted to the upper side and the lower side of the cover cabinet 140 of the laundry dryer, respectively.

The opening 310 in the lower panel frame 300 is on a straight line with a position of the heater assembly 200 in the body case 100.

Then, since the cable (not shown) connected to the various components in the body case 100 is exposed from an outside of the lower panel frame 300, the cable connected to the circuit board 410 of the control panel 400 is electrically connected to the cable connected to the components in the body case 100.

Then, as the control panel 400 is mounted to the lower panel frame 300, a process for mounting the control panel 300 to the laundry dryer is finished.

Along with this, the cover panel 600 is mounted to the upper panel frame 500 by a method the same with a method of mounting the control panel 400 to the lower panel frame 300.

In the meantime, a process for taking out the heater assembly out of the body case will be described.

At first, a process of mounting the control panel 400 to the lower panel frame 300 is progressed reversely, to dismount the control panel 400 from the lower panel frame 300.

Then, a series of work for detaching the heater assembly 200 mounted on an inside of the body case 100 is progressed through the opening 310 of the lower panel frame 300.

Upon finish of the work, the worker can take the heater assembly 200 out of the body case 100 through the opening 310, easily.

A work for mounting the heater assembly 200 in the body case 100 is progressed in a process reverse to above process, of which detailed description will be omitted.

In the meantime, it is described that the control panel 400 can be mounted/dismounted to the upper side or the lower side of the cover cabinet 140, selectively.

This is for easy operation of the operation buttons on each of the control panels even if two or more than two laundry dryers are arranged in any type.

States of the control panels arranged different from one another depending on states of two or more than two dryers arranged different from one another will be described with reference to FIGS. 4 and 5.

Figure 4:
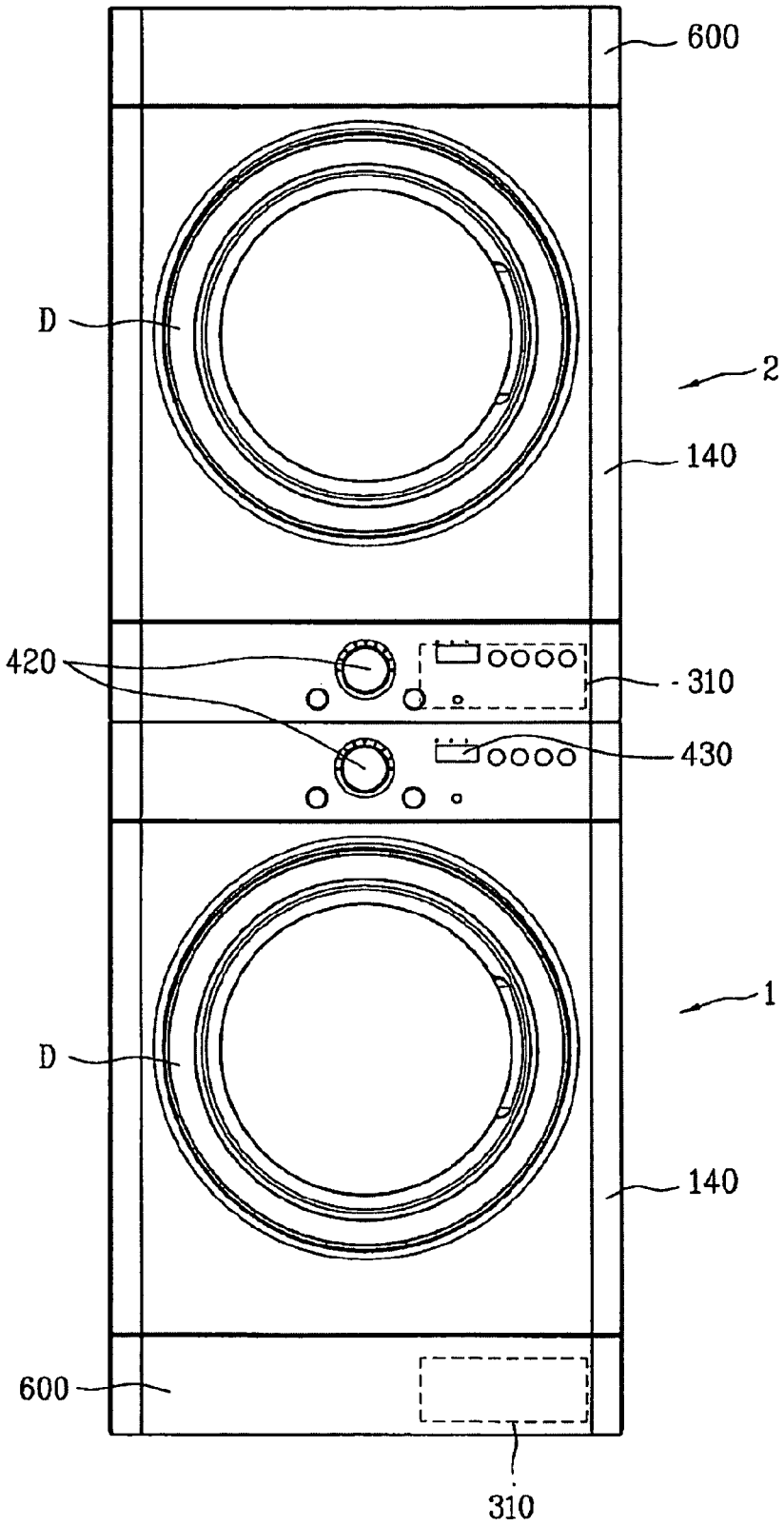
FIG. 4 is a front view illustrating the laundry dryers of the present invention arranged in an up/down direction.

FIG. 4 illustrates a state in which another dryer 2 (hereafter called as 'a second dryer') is stacked on a dryer 1 (hereafter called as 'a first dryer') supported on a floor.

In this case, it is preferable that the control panel 400 of the second dryer 2 is mounted to the lower panel frame 300 of the second dryer 2.

This is for enabling the user to use the operation buttons 420 and the display window 430 of the control panel 400 conveniently, taking a general height of the user into account.

In this instance, the cover panel 600 is mounted to the upper panel frame 500 of the second dryer 2.

Figure 5:
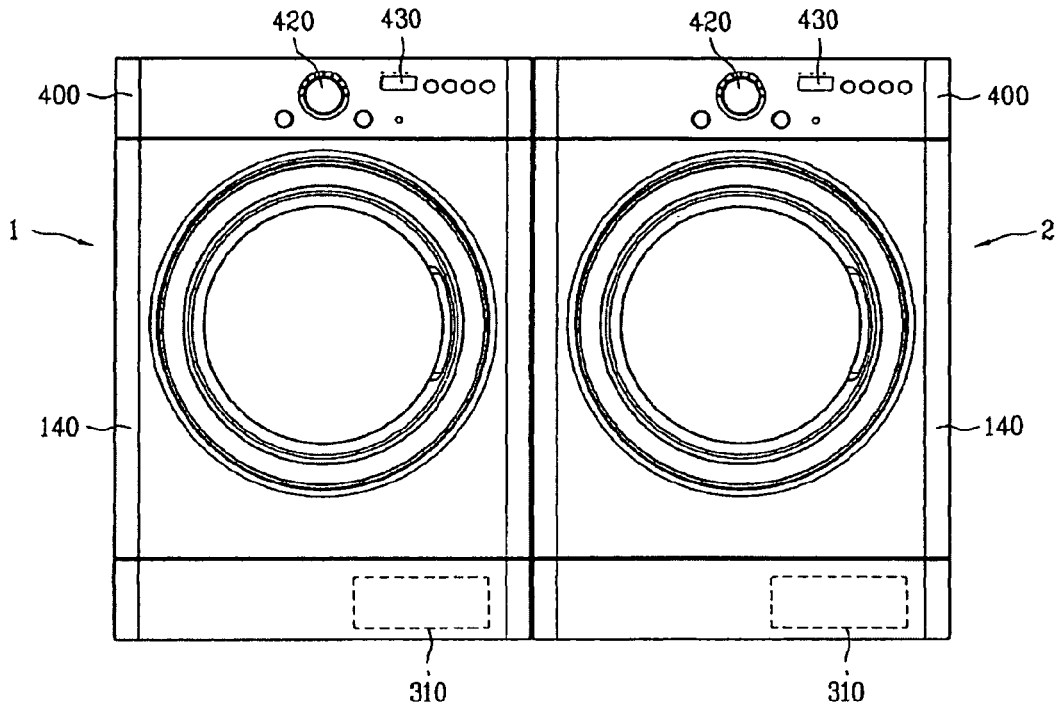
FIG. 5 is a front view illustrating the laundry dryers of the present invention arranged side by side.

On the other hand, FIG. 5 illustrates a state the second dryer 2 is arranged on a side (a right side) of the first dryer 1.

In this case, it is preferable that the control panel 400 of the second dryer 2 is mounted to the upper panel frame 500 of the second dryer 2.

Referring to FIG. 4, it is for preventing the user from bending the body or squatting down for operation of the operation buttons 420 on the control panel 400 in a case the control panel 400 of the second dryer 2 is mounted to the lower panel frame 300 of the second dryer 2.

By enabling to vary a position of the control panel 400 according to an arrangement of the laundry dryer, the user can handle the operation buttons on the control panel, conveniently.

eventually, at the time the operation buttons 420 or the circuit board 410 of the control panel 400 is replaced or repaired, not only the control panel 400 can be dismounted from the laundry dryer and perform an appropriate work, but also the heater assembly 200 can be taken out of through the opening 310 easily and perform an appropriate work when the heater assembly 200 is out of order.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry dryer, comprising:

a body case that forms an exterior of the laundry dryer;

a drum provided in the body case that holds an object to be dried;

a heater assembly provided in the body case that heats air to supply hot air to the drum;

a plurality of panel frames provided on a front panel of the body case, wherein at least one of the plurality of panel frames includes an opening, and wherein the opening is in communication with a space having the heater assembly mounted therein and is configured to allow the heater assembly to be directly taken out therethrough to an outside of the laundry dryer; and a control panel mounted to one of the plurality of panel frames, selectively, and having buttons configured to control operations of the laundry dryer.

2. The laundry dryer of claim 1, wherein the plurality of panel frames includes an upper panel frame on an upper side of the front panel of the body case and a lower panel frame on a lower side of the front panel of the body case.

3. The laundry dryer of claim 2, wherein the heater assembly is mounted in the body case at a lower portion thereof.

4. The laundry dryer of claim 3, wherein the lower panel frame includes the opening.

5. The laundry dryer of claim 1, wherein the opening and the heater assembly are arranged in a straight line.

6. The laundry dryer of claim 5, wherein a size of the opening is sufficient to allow the heater assembly to be taken out of the laundry dryer therethrough.

7. The laundry dryer of claim 2, wherein the control panel is mounted to the upper panel frame or the lower panel frame, selectively.

8. The laundry dryer of claim 7, further comprising a cover panel that covers the other panel frame when the control panel is mounted to one of the upper panel frame and the lower panel frame.

9. The laundry dryer of claim 1, further comprising at least one cover panel that covers the plurality of panel frames on which the control panel is not mounted.

10. The laundry dryer of claim 1, wherein centerlines of the opening and the heater assembly are arranged in a common line.

11. The laundry dryer of claim 1, wherein the one of the plurality of panel frames is mounted backward by a predetermined distance from a front surface of the body case to receive the control panel.

12. The laundry dryer of claim 1, wherein a front surface of the control panel is flush with the front surface of the body case.

* * * * *